US005115748A

United States Patent [19]

Westlake

[11] Patent Number: 5,115,748

[45] Date of Patent: May 26, 1992

[54] HOPPER DOOR AND OPERATING APPARATUS FOR A RAILWAY CAR

[75] Inventor: Wayne S. Westlake, McComb, Ohio

[73] Assignee: Differential Steel Car Company, Findlay, Ohio

[21] Appl. No.: 601,981

[22] Filed: Oct. 23, 1990

[51] Int. Cl.[5] ..... B61D 7/16

[52] U.S. Cl. ..... 105/286; 105/240; 105/245; 105/251; 105/255; 105/299

[58] Field of Search ..... 105/240, 241.2, 244, 105/245, 250, 251, 255, 282.1, 286, 299

[56] References Cited

U.S. PATENT DOCUMENTS

| | | | |
|---|---|---|---|
| 2,600,357 | 6/1952 | Zimmerman | 105/292 |
| 2,729,503 | 1/1956 | Armington | 105/283 |
| 3,122,106 | 2/1964 | Novelli | 105/249 |
| 3,173,381 | 3/1965 | Charles et al. | 105/240 |
| 3,596,608 | 8/1971 | Aquino et al. | 105/251 |
| 3,786,764 | 1/1974 | Beers, Jr. et al. | 105/240 |
| 3,902,434 | 9/1975 | Barnard et al. | 105/240 |
| 4,114,785 | 9/1978 | Dugge | 105/283 |
| 4,138,948 | 2/1979 | Korolls | 105/251 |
| 4,222,333 | 9/1980 | Schuller | 105/250 |
| 4,224,877 | 9/1980 | Stark et al. | 105/250 |
| 4,262,601 | 4/1981 | Miller | 105/241.2 |
| 4,325,308 | 4/1982 | Erfurth | 105/280 |
| 4,452,149 | 6/1984 | LeMarbe | 105/250 |
| 4,740,130 | 4/1988 | Prins | 105/241.2 |

*Primary Examiner*—Joseph F. Peters, Jr.
*Assistant Examiner*—Virna Lissi Mojica
*Attorney, Agent, or Firm*—Marshall & Melhorn

[57] ABSTRACT

A door and operating apparatus for railway hopper cars includes a door having a first pivot point for rotary attachment to the hopper. A second pivot point is formed on the door and a cross beam is positioned adjacent to the door for movement in a vertical direction. The cross beam has a third pivot point formed thereon and a link arm has one end rotatably attached to the door at the second pivot point and an opposite end rotatably attached to the cross beam at the third pivot point. A screwjack is coupled to vertically move the cross beam in an upward direction for opening the doors and in a downward direction for closing the doors. The doors have an arcuate surface extending generally vertically when in the closed position to reduce the effort required to open the doors when the car is loaded.

20 Claims, 4 Drawing Sheets

HOPPER DOOR AND OPERATING APPARATUS FOR A RAILWAY CAR

BACKGROUND OF THE INVENTION

The present invention relates generally to railway hopper cars and, in particular, to door operating mechanisms for discharging material from bottom discharge hoppers.

A number of different types of railroad cars exist for hauling various types of bulk cargo and for discharging that cargo. For example, railway hopper cars carry coal, sand, aggregates and other loose materials which materials can be discharged through openings in hoppers located beneath such cars.

Generally, the hopper cars have a plurality of hoppers which store the cargo in readiness for discharge. A variety of door mechanisms are utilized to open and close material discharge openings formed in the bottoms of the hoppers. U.S. Pat. No. 2,600,357 discloses a door operating mechanism for a pair of longitudinally disposed discharge doors pivoted about generally horizontal axes which doors open and close an open bottom of a railway dump car. The doors are held closed by a latching mechanism and when the latch is released, the doors pivot downwardly to allow the material to exit the car. The doors are connected to a vertically upwardly extensible hydraulic actuator by cables for raising the doors to the closed position and holding the doors closed until the latching mechanism is actuated. Similar apparatuses are disclosed in U.S. Pat. Nos. 3,122,106; 3,596,608; 3,902,434; and 4,262,601. Also related to the door operating mechanisms shown in the aforementioned patents is U.S. Pat. No. 4,740,130 which shows a bottom discharge hopper having a body which is elevated by ramps so that the doors on the underside of the body can open outwardly and downwardly to permit material discharge from the body.

U.S. Pat. Nos. 3,173,381 and 2,729,503 disclose hoppers which utilize "clam shell" doors operated by separate actuators.

U.S. Pat. No. 3,786,764 discloses a commodity discharge car in which longitudinally spaced hoppers are closed by a pair of doors which overlap in a closed position approaching the horizontal. As the doors pivot open, they are rotated to a generally vertical position by a rack and pinion operating mechanism.

U.S. Pat. No. 4,452,149 discloses a door operating mechanism for a railway hopper car having doors with arcuate shaped sealing surfaces which doors are pivoted upwardly and outwardly to open a bottom discharge outlet of the hopper car. U.S. Pat. No. 4,114,785 discloses a similar rotary operated door mechanism for a hopper, with the doors having a generally planar body which is rotated downwardly.

U.S. Pat. No. 4,138,948 discloses a door operating mechanism in a side dump railway car which mechanism opens and closes outwardly movable discharge doors to discharge bulk material sideways from the hopper car.

SUMMARY OF THE INVENTION

The present invention concerns a door operating apparatus for railway hopper cars for discharging bulk material from the car. A longitudinally extending door is positioned in a discharge opening and is rotatably attached to the hopper at a first pivot point. A second pivot point is formed on the door and is rotatably attached to one end of a link arm. A generally horizontally extending cross beam is positioned adjacent to the door for movement in a vertical direction. The cross beam has a third pivot point formed thereon which is rotatably connected to the other end of the link arm.

A pneumatic motor drives a nut of a screwjack in a vertical direction, which nut is attached to the cross beam. When the cross beam is moved in an upward direction, the link arm rotates the door about the first pivot point to the open position of the door. When the cross beam is moved in a downward direction, the link arm rotates the door in an opposite direction about the first pivot point to the closed position of the door.

A means for manually selecting opening, closing and stop modes of operation includes a rod rotatably mounted on an end of the hopper, opposite ends of the rod extending to opposite sides of the hopper and terminating in handles. The rod is attached to a control valve whereby rotation of the rod to one of three positions actuates the control valve to establish an associated one of the modes of operation. A pneumatic motor is coupled to rotate a screw jack attached to the cross beam and the control valve operates the motor from a pneumatic source for selectively rotating the screw in opposite directions of rotation to raise and lower the cross beam. A shut-off mechanism is responsive to the position of the cross beam for stopping the movement of the cross beam when the door is in the open and the closed positions. A locking mechanism maintains the rod in the selected one of the three positions.

An object of the present invention is to increase the aerodynamic characteristics of railway hopper cars by streamlining the hopper door operating mechanism.

Another object of the present invention is to increase the effectiveness of the seal between the hopper door and the discharge opening of a the hopper car.

Still another object of the present invention is to decrease the effort required to open the hopper doors of a railway hopper car loaded with bulk material.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
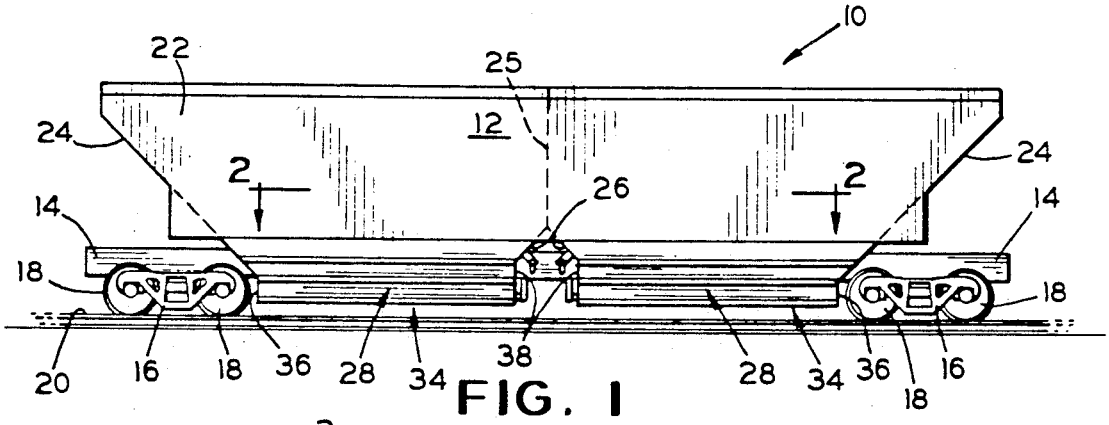
FIG. 1 is an elevation view of a railway hopper car in accordance with the present invention.
Figure 2:
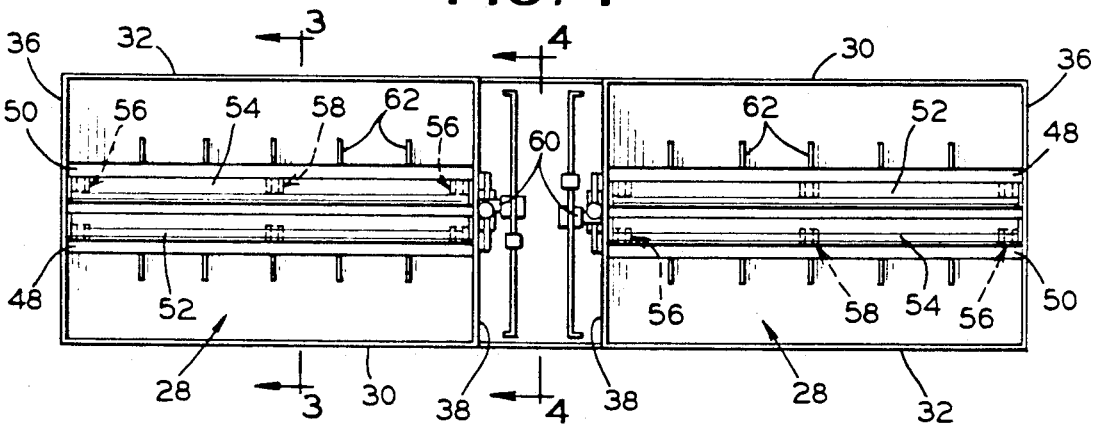
FIG. 2 is top plan schematic view of the hoppers of the railway car shown in FIG. 1 as if taken in cross section along the line 2—2 and enlarged with the doors open.
Figure 3:
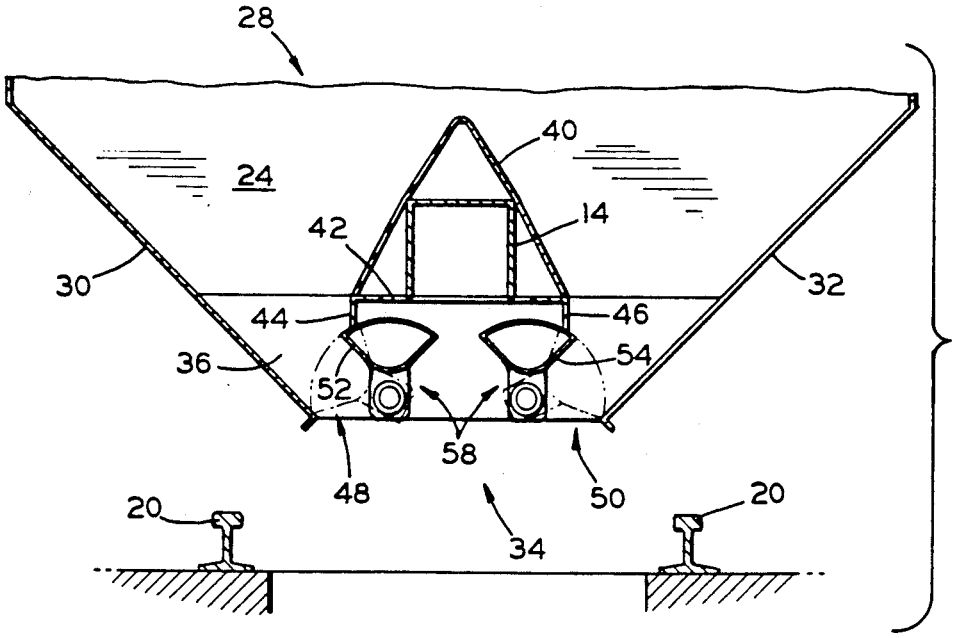
FIG. 3 is a cross-sectional view of one of the hoppers shown in FIG. 2 as if taken along the line 3—3 and enlarged.

Referring to FIGS. 1 through 3, there is illustrated a hopper-type railway car, for transporting bulk materials, generally indicated by the reference numeral 10. The car 10 has a body 12 mounted on a frame 14 which frame is supported at opposite ends by a pair of conventional trucks 16 each having four wheels 18 for engaging a pair of rails 20 (only one is shown in FIG. 1) of a railroad track. The body 12 includes a pair of generally parallel and longitudinally extending sidewalls 22 (only one is shown) each of which extends vertically upwardly and flares outwardly in an upper portion thereof. Adjacent ends of the sidewalls 22 are joined by a pair of generally vertically downwardly and inwardly extending end walls 24. At a central portion of the car body 12, a generally vertical central wall 25 is attached to the sidewalls 22 to divide the car body in half and terminates at a lower edge in a pair of interior walls 26 which are attached to and extend between the sidewalls 22 in an inverted "V-shape" to form two openings in the car bottom for a pair of hoppers as described below.

The two openings in the car bottom each communicate with an associated one of a pair of hoppers 28 attached to the bottom of the car 12. The hoppers 28 are carried on the frame 14 to support the body 12 and are shown schematically in FIG. 2. The hoppers 28 are identical in construction, the configuration of which is illustrated in FIGS. 2 and 3, and are oriented in opposite directions. Each of the hoppers 28 is formed of a pair of generally longitudinally extending sidewalls 30 and 32 extending downwardly and inwardly from the sidewalls 22 to form a longitudinally extending elongated discharge opening 34. Edges of the sidewalls 30 and 32 adjacent the trucks 16 are joined by a generally vertical outer end wall 36 which is attached to and extends vertically downwardly from a lower edge of the end wall 24. Edges of the sidewalls 30 and 32 adjacent the center of the body 12 are joined by a generally vertically extending inner end wall 38. An upper edge of the inner end wall 38 is attached to a lower edge of the adjacent interior wall 26.

The frame 14 is formed as a box beam which extends through the end walls 36 and 38. The frame 14 is aligned longitudinally with and above the openings 34. Inside each of the hoppers 28, the frame is enclosed by a shield 40 having an inverted V-shape. The shield 40 has a pair of legs which extend downwardly and outwardly from an apex and contact upper edges of the frame beam 14. The legs continue downwardly and outwardly terminating in edges which abut and are attached to opposite ends of generally horizontally extending plates 42. The plates 42 are positioned at opposite ends and the center of each of the hoppers 28 above hinges which are described below. The longitudinal edges of the plates 42 are attached to a pair of longitudinally extending L-shaped flanges 44 and 46 positioned to cooperate with the sidewalls 30 and 32 respectively and divide the discharge opening 34 into a pair of generally parallel, longitudinally extending outlet ports 48 and 50 respectively The shield 40, the plates 42 and the frame 14 are not shown in FIG. 2 in order to reveal the doors which are described below.

The outlet ports 48 and 50 can be selectively opened and closed by an associated pair of doors 52 and 54 respectively. The doors 52 and 54 are hollow and have an inverted bell shape in cross section as best seen in FIG. 3. Each of the doors is rotatably mounted on the hopper by three hinges, a pair of end hinges 56 and a center hinge 58. The doors 52 and 54 associated with each of the hoppers 28 can be selectively rotated between closed and open positions by a door actuator assembly 60 for loading bulk material into the car 10 and discharging the material respectively as will be discussed below. Internal to each of the hoppers 28 are a plurality of spaced-apart ribs 62 which are attached to the sidewalls 30 and 32. The ribs 62 extend upwardly from each of the outlets 48 and 50 to add support to stiffen the sidewalls 30 and 32.

Figure 4:
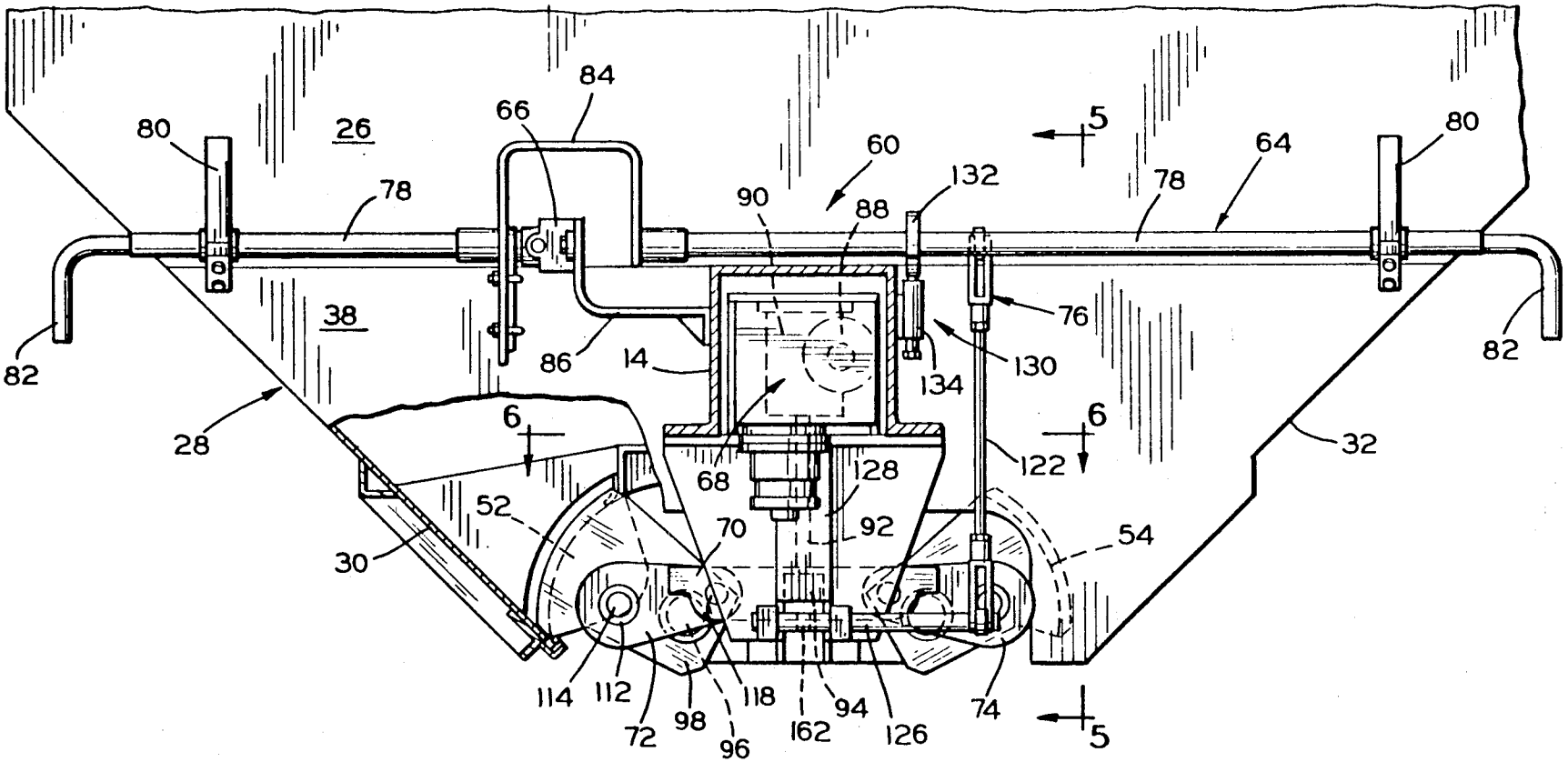
FIG. 4 is a cross-sectional view of one of the hoppers shown in FIG. 2 as if taken along the line 4—4 and enlarged with the doors closed.
Figure 5:
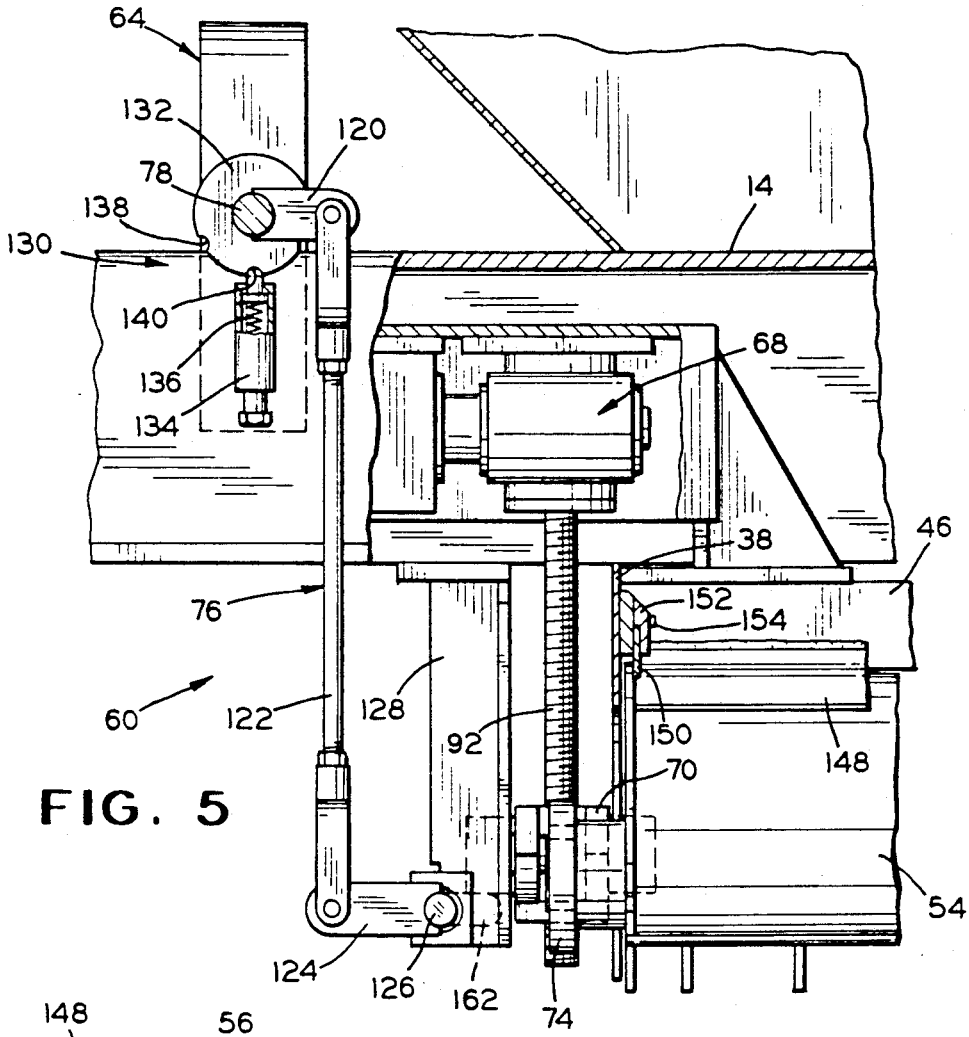
FIG. 5 is an enlarged fragmentary cross-sectional view of the hopper shown in FIG. 4 taken along the line 5—5.
Figure 6:
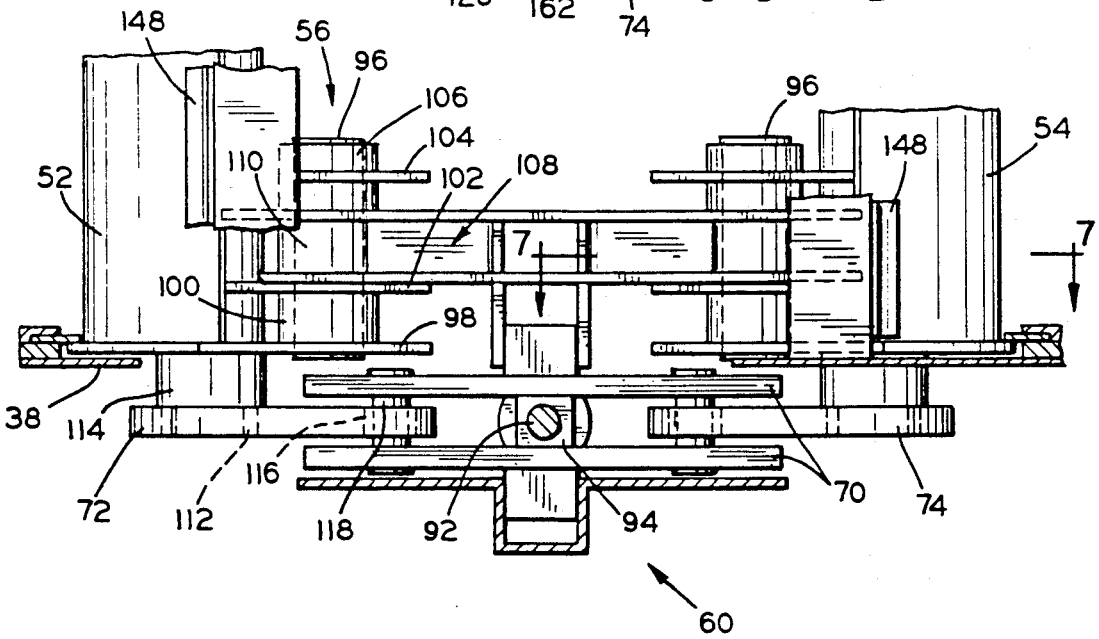
FIG. 6 is an enlarged fragmentary cross sectional view of the hopper shown in FIG. 4 taken along the line 6—6.

The door actuator assembly 60, as illustrated in FIGS. 4 through 6, includes a handle assembly 64 connected to actuate a control valve 66 for turning on and off a conventional pneumatic motor driven screw jack 68. The screw jack is connected to move a cross beam 70 in a vertical direction and the beam 70 is coupled to a pair of link arms 72 and 74 which in turn are coupled to the doors 52 and 54 respectively. A shut-off mechanism 76 is coupled between the handle assembly 64 and the bottom of the screw jack 68 to automatically shut off the pneumatic motor when doors 52 and 54 are closed.

The handle assembly 64 includes horizontally disposed actuating rod 78 rotatably attached to the end wall 24 by a pair of brackets 80. The ends of the rod 78 are formed at right angles to its longitudinal axis to function as handles 82 for rotating the rod. The rod 78 is split and adjacent ends are interconnected by an inverted J shaped bracket 84. A longer leg of the bracket 84 is attached to the actuator of the control valve 66 while the body of the valve is attached to a bracket 86 mounted on the frame 14.

The frame 14 provides support for and encloses a pneumatic motor 88 and a gear box 90 of the screw jack 68. The motor drives a vertically disposed screw 92 through the gear box and the screw is coupled to a nut 94 which is attached to the cross beam 70. As the cross beam 70 is moved along the screw 92, the doors 52 and 54 are opened and closed as discussed below.

The door 52 is rotatably mounted adjacent the door actuator assembly 60 at a first pivot point by one of the end hinges 56. Each of the end hinges 56 includes a pin 96 having a longitudinal axis defining the first pivot point. The door 52 has an end attached to one end of a first hinge bracket 98. The bracket 98 has an aperture formed in an opposite end thereof for receiving an end of the pin 96. A sleeve bearing 100 is attached to the hinge bracket 98 and positioned concentrically with the aperture such that the bracket 98 and the door 52 rotate about the first pivot point. A second hinge bracket 102 has one end attached to the door 52 and an opposite end attached to the sleeve bearing 100 such that the brackets 98 and 102 are spaced apart by the sleeve bearing 100. A third hinge bracket 104 has one end attached to the door 52 and a sleeve bearing 106 extends through and is attached to an opposite end of the bracket 104. The sleeve 106 is spaced from the bracket 102 by a frame mounting bracket 108 having a sleeve bearing 110. The bracket 108 is attached to the frame 14 such that the bracket 108 and the sleeve bearing 110 form one half of the hinge 56 and the brackets 98, 102 and 104 and the sleeve bearings 100 and 106 form the other half, the two halves being coupled by the pin 96.

The link arm 72 has an aperture formed at an outer end thereof for retaining a bushing 112. The bushing 112 receives a reduced diameter end of a shaft 114 which has a larger diameter end attached to the bracket 98. The longitudinal axis of the shaft 114 defines a second pivot point about which the door 52 and the link arm 72 rotate. An inner end of the link arm 72 has an aperture formed therein for retaining a bushing 116. A pin 118 is rotatably mounted in the cross beam 70 and extends through the bushing 116. The longitudinal axis of the pin 118 defines a third pivot point about which the link arm 72 can rotate.

Figure 9:
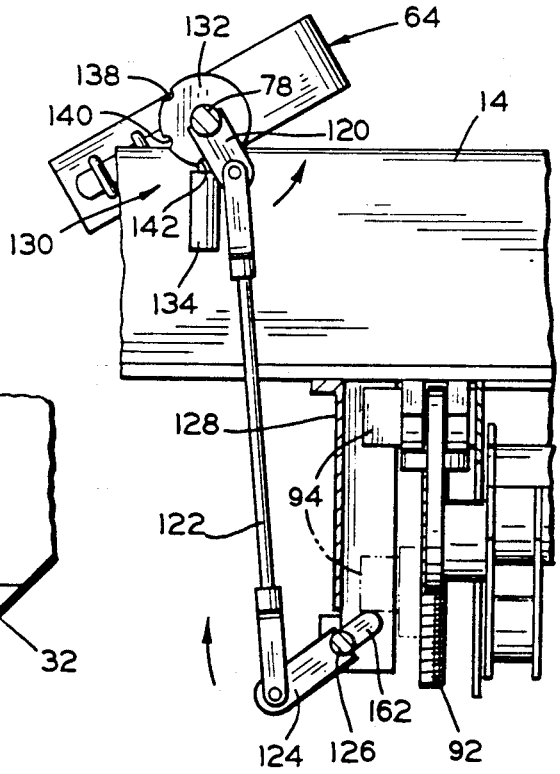
FIG. 9 is an enlarged fragmentary cross sectional view of the door operating apparatus, similar to FIG. 5, showing the door open position.

The shut-off mechanism 76 extends downwardly from the rod 78 to the base of the screw 92 as illustrated in FIGS. 4, 5 and 9. The shut-off mechanism 76 includes a first arm 120 having one end attached to the rod 78 and extending radially outwardly therefrom. The opposite end of the arm 120 is Pivotally connected to an upper end of a generally vertically extending connecting link 122 having a lower end pivotally connected to one end of a second arm 124. An opposite end of the second arm 124 is attached to a shaft 126 rotatably mounted on a bracket 128 attached to and extending downwardly from the frame 14.

The shut-off mechanism 76 also includes a multi-position locking mechanism 130 for maintaining a position of the handle assembly 64 determined by either the shut-off mechanism 76 or by manual rotation of the handles 82. The locking mechanism 130 is located on the cross beam 70 between the frame 14 and the shut-off mechanism 76. The locking mechanism 130 includes a cam 132 mounted concentrically on the rod 78. The cam 132 has three notches formed approximately sixty degrees apart in its periphery for receiving a vertically slidable stop member 134 biased to an engaged position by a spring 136. When the member 134 engages one of the notches, the rod 78 is prevented from rotating. The three notches 138, 140 and 142 of the cam 132 represent the opening stop, and closing modes of operation of the doors, respectively.

Figure 7:
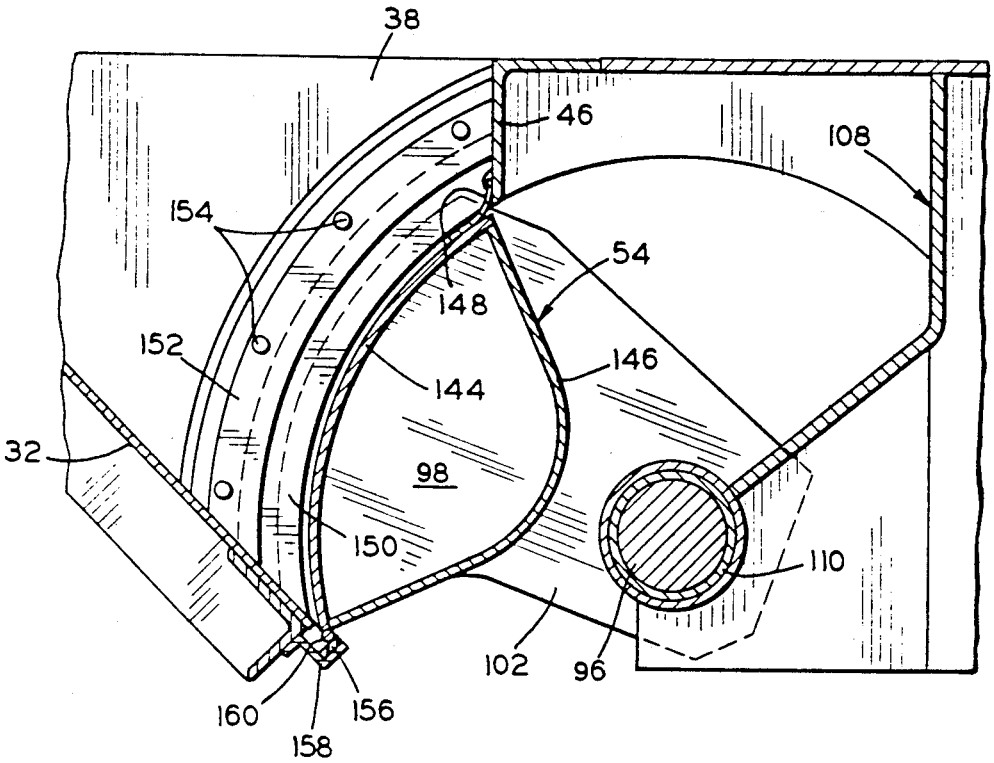
FIG. 7 is an enlarged fragmentary cross sectional view of the door of the hopper shown in FIG. 6 taken along the line 7—7.

As shown in FIGS. 4, 5 and 7, the doors 52 and 54 are formed as hollow structures having an arcuate wall 144 with an outer surface facing into the hopper and a generally U-shaped wall 146, the longitudinal edges of the walls being connected. The ends of the doors are closed by the brackets 98 and seals are provided around the openings 48 and 50 for sealing at the peripheries of the doors in the closed position.

As illustrated in FIGS. 5 through 7, a lip seal 148 extends the length of each of the flanges 44 and 46 and has one edge attached thereto. The lip seal 148 has an opposite edge which slidingly and sealingly engages the outer surface of the doors 52 and 54. An end seal 150 is contoured to the arcuate shape of the wall 144 and is attached to the inner end wall 38 by a mounting bracket 152 and suitable fasteners 154. A similar end seal (not shown) is provided on the outer end wall 36. The seals 150 sealingly overlap the brackets 98. A pressure seal 156 is positioned in a seal retainer 158 attached to a lower edge of the side wall 32 as shown in FIG. 7. A sealing flange 160 is provided on the abutting edge of door the 54 which flange 160 sealingly cooperates with the seal 156 in a closed position of the door 54. As stated above, the door 52 is provided with similar seals. These seals function to prevent discharge of the bulk material from the hoppers 28 when the doors 52 and 54 are closed. The bulk material applies a force on the closed doors 52 and 54 and the seals 148 and 150 thereby providing a positive seal about the periphery of the doors.

To actuate the door operating apparatus according to the present invention, an operator turns either of the handles 82 to rotate the rod 78 in the desired direction. The direction of rotation will determine whether the doors will open, stop or close. For example, if the doors are in the closed position as illustrated in FIGS. 4 and 5, the notch 140 is engaged by the stop member 134, the arms 120 and 124 are in a generally horizontal position and the nut 94 abuts an end-of-travel extension 162 attached to the shaft 126. If the rod 78 is rotated in a counter-clockwise direction viewed as in FIG. 5, the cam 132 will be rotated to engage the notch 138 with the stop member 134. The rotation of the rod 78 also actuates the valve 66 which connects the motor 88 to a source of pneumatic power to rotate the screw 92 and raise the cross beam 70. When the cross beam 70 reaches the top of the screw 92, as shown in the FIG. 8, further upward movement is blocked by the frame 14. The valve can then be shut off by any suitable means. The rod 78 can remain in the open position just described or can be returned to the stop position shown in FIG. 5.

Figure 8:
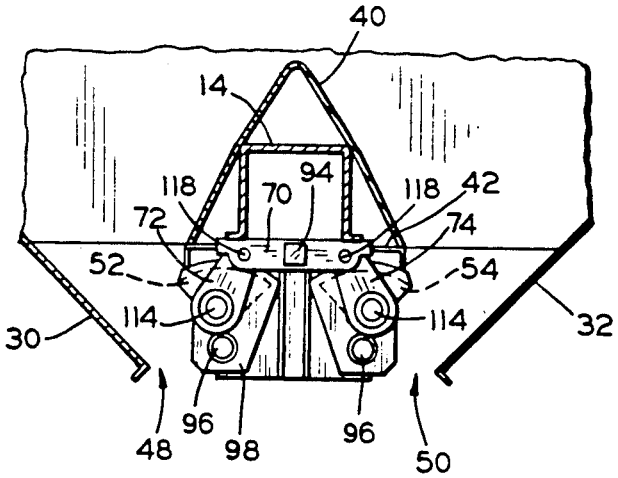
FIG. 8 is a schematic elevational view of the hopper according to the present invention showing the doors in an opened position.

As the cross beam 70 moves upwardly, the link arms 72 and 74 rotate about the third pivot points toward a more vertical position as shown in FIG. 8. The movement of the link arms causes rotation about the second pivot points and the first pivot points to open the doors 52 and 54 thereby allowing discharge of material from the hopper through the outlet ports 48 and 50 respectively. The curved surfaces of the doors 52 and 54 are nearly vertical in the closed position and slide along the material in the hopper with little resistance to facilitate the opening of the doors.

To close the doors 52 and 54, the rod 78 is rotated to engage the notch 142 with the stop member 134 as illustrated in FIG. 9. The control valve 66 is actuated to reverse the motor 88 and move the cross beam 70 downwardly to the position shown in FIG. 4. As the nut 94 moves down the screw 92, the nut engages the extension 162 of the shut-off mechanism 76 in the position shown in phantom in FIG. 9. The nut 94 forces the extension 162 downward until the extension is generally horizontally disposed. The downward movement of the extension 162 effectuates an upward movement of the link 122 causing the rod 78 to rotate the cam 132 to the stop position where the notch 140 engages the stop member 134 and the motor 88 is turned off. The doors 52 and 54 are now closed again. The handles 82 also can be used to manually actuate the control valve 66 and position and stop the doors in any partially open position.

The positioning of the doors 52 and 54 in the opening 34 above the bottom of the hopper provides a hopper car 10 which has increased aerodynamics over cars having external door mechanisms. The door operating apparatus according to the present invention is moved out of the airstream passing by the car thereby increasing the fuel efficiency of a train including the car 10.

The shape and positioning of the doors provides outlet ports extending the entire length of the hopper compartment. Thus, a single hopper in accordance with the present invention can replace several smaller prior art hoppers thereby increasing the capacity of the hopper for storing a greater quantity of cargo material. The larger capacity hopper also lowers the center of gravity of the loaded car thereby making the car more stable. Furthermore, the larger single discharge outlet versus the smaller prior art outlets facilitates an increase in the discharge rate of the car.

The pneumatic motor and the screwjack are means for selectively moving the cross beam in a vertical direction whereby when the cross beam is moved in an upward direction, the door is rotated about the first pivot point to the open position and, when the cross beam is moved in a downward direction, the door is rotated about the first pivot point to the closed position. Of course, the cross beam can be moved by any suitable actuator such as a pneumatic or hydraulic piston and cylinder type actuator.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A door operating apparatus for use in discharging bulk material from a hopper on a railway car comprising:

a door for closing a material discharge opening formed in a hopper, said door having a first pivot point for rotary attachment to the hopper and a second pivot point formed thereon and said door being rotatable about the first pivot point between an open position and a closed position;

a cross beam positioned adjacent to said door for movement in a vertical direction and having a third pivot point formed thereon;

a link arm having one end rotatably attached to said door at the second pivot point and an opposite end rotatably attached to said cross beam at the third pivot point: and means for selectively moving said cross beam in a vertical direction whereby when said cross beam is moved in an upward direction, said door is rotated about the first pivot point to the open position and, when said cross beam is moved in a downward direction, said door is rotated about the first pivot point to the closed position.

2. The apparatus according to claim 1 wherein the hopper extends in a longitudinal direction beneath a railway car and said door and the discharge opening extend in a longitudinal direction a length of the hopper.

3. The apparatus according to claim 1 wherein said door has an arcuate surface formed thereon extending across a width of the discharge opening for closing the discharge opening in the closed position of said door.

4. The apparatus according to claim 1 including a plurality of seals attached to the hopper and positioned about a periphery of the discharge opening for sealingly engaging a periphery of said door when said door is in the closed position.

5. The apparatus according to claim 1 wherein said means for selectively moving said cross beam includes a screw jack having a nut attached to said cross beam and a rotatable screw threadably engaging said nut for moving said cross beam in the upward and the downward directions.

6. The apparatus according to claim 5 wherein said means for selectively moving said cross beam includes a pneumatic motor coupled to rotate said screw and a control valve connected to said motor for operating said motor from a pneumatic source for selectively rotating said screw in opposite directions of rotation.

7. The apparatus according to claim 1 wherein said means for selectively moving includes a shut-off mechanism responsive to the position of said cross beam for stopping the movement of said cross beam when said door is in the open and the closed positions.

8. The apparatus according to claim 1 wherein said means for selectively moving includes means for manually selecting opening, closing and stop modes of operation and a locking mechanism for maintaining said means for manually selecting in a selected one of the modes of operation.

9. The apparatus according to claim 8 wherein said means for manually selecting includes a rod rotatably mounted on an end of the hopper, opposite ends of said rod extending to opposite sides of the hopper and terminating in handles, said rod being attached to a control valve whereby rotation of said rod to one of three positions actuates said control valve to establish an associated one of said modes of operation.

10. The apparatus according to claim 9 wherein said means for selectively moving includes a pneumatic motor coupled to rotate a screw jack attached to said cross beam and said control valve is connected to said motor for operating said motor from a pneumatic source for selectively rotating said screw in opposite directions of rotation.

11. The apparatus according to claim 1 wherein said door is a first door for closing a first outlet port in the discharge opening and said link arm is a first link arm, and including a second door for closing an associated second outlet port in the discharge opening, said second door having a fourth pivot point for rotary attachment to the hopper and a fifth pivot point formed thereon and said second door being rotatable about the fourth pivot point between an open position and a closed position said cross beam having a sixth pivot point formed thereon, and a second link arm having one end rotatably attached to said second door at the fifth pivot point and an opposite end rotatably attached to said cross beam at the sixth pivot point whereby when said cross beam is moved in an upward direction, said second door is rotated about the fourth pivot point to the open position and, when said cross beam is moved in a downward direction, said second door is rotated about the fourth pivot point to the closed position.

12. A railway hopper car for transporting and discharging bulk materials comprising:

a car body for holding bulk material and having a pair of side walls attached to a pair of end walls and an open bottom;

at least one hopper attached to and open to said bottom of said car body, said hopper having a bottom discharge opening for discharging the bulk material from said car body;

a door for closing the discharge opening said door being rotatably attached to said hopper at a first pivot point and having a second pivot point formed thereon, said door being rotatable about the first pivot point between an open position and a closed position at the discharge opening;

a cross beam positioned adjacent to said door for movement in a vertical direction and having a third pivot point formed thereon;

a link arm having one end rotatably attached to said door at the second pivot point and an opposite end rotatably attached to said cross beam at the third pivot point; and means for selectively moving said cross beam in a vertical direction whereby when said cross beam is moved in an upward direction, said door is rotated about the first pivot point to the open position and, when said cross beam is moved in a downward direction, said door is rotated about the first pivot point to the closed position.

13. The railway hopper car according to claim 12 wherein said door has a curved surface facing the discharge opening, said curved surface being in a generally vertical plane when said door is in the closed position.

14. The railway hopper car according to claim 12 including a lip seal attached to said hopper along one longitudinally extending edge of the discharge opening, a surface of said door slidably abutting said lip seal as said door is moved between the open and the closed positions.

15. The railway hopper car according to claim 12 including a pressure seal attached to said hopper along one longitudinally extending edge of the discharge opening, an edge said door sealingly abutting said pressure seal when said door is in the closed position.

16. The railway hopper car according to claim 12 including a pair of end seals attached to said hopper along opposite end edges of the discharge opening, said end seals slidably overlapping associated hinge brackets attached to opposite ends of said door as said door is moved between the open and the closed positions.

17. The railway hopper car according to claim 12 wherein said hopper extends a substantial distance in a longitudinal direction beneath said car body and said door and the discharge opening extend in a longitudinal direction a length of said hopper, said hopper forming an enclosure for bulk material whereby a center of gravity of the car is lowered.

18. The railway hopper car according to claim 12 wherein said means for selectively moving includes means for manually selecting opening, closing and stop modes of operation and a locking mechanism for maintaining said means for manually selecting in a selected one of the modes of operation, a rod rotatably mounted on an end of the hopper, opposite ends of said rod extending to opposite sides of the hopper and terminating in handles, said rod being attached to a control valve whereby rotation of said rod to one of three positions actuates said control valve to establish an associated one of the modes of operation, and a pneumatic motor coupled to rotate a screw jack attached to said cross beam and wherein said control valve is connected to said motor for operating said motor from a pneumatic source for selectively rotating said screw in opposite directions of rotation.

19. The railway hopper car according to claim 12 including means for manually selecting opening, stopped and closing modes of operation of said means for selectively moving and a locking mechanism for maintaining said means for manually selecting in a selected one of the modes of operation.

20. A door operating apparatus for railway hopper car for discharging bulk materials from the car comprising:

a pair of elongated doors for closing outlet ports in a discharge opening in the bottom of a hopper, each said door having a first pivot point for rotatable attachment to the hopper and a second pivot point;

a cross beam positioned adjacent one end of said doors for movement in a vertical direction and having a pair of third pivot points formed thereon;

a pair of link arms, each said link arm having one end rotatably attached to one of said doors at the second pivot point and an opposite end rotatably attached to said cross beam at one of the third pivot points: and means for selectively moving the cross beam in a vertical direction whereby when the cross beam is moved in an upward direction, said doors are rotated about the first pivot points to an open position and, when the cross beam is moved in a downward direction, said doors are rotated about the first pivot points to the closed position.

* * * * *